US010576776B2

(12) United States Patent
Ballot et al.

(10) Patent No.: US 10,576,776 B2
(45) Date of Patent: Mar. 3, 2020

(54) RETRACTABLE LIQUID APPLICATOR DEVICE

(71) Applicant: FLOCON, Inc, Woodstock, IL (US)

(72) Inventors: Stephan M Ballot, Barrington Hills, IL (US); Robert D Forschler, Crystal Lake, IL (US); Fred M Ekstrom, Algonquin, IL (US)

(73) Assignee: Flocon, Inc, Woodstock, IL (US)

( * ) Notice: Subject to any disclaimer, the term of this patent is extended or adjusted under 35 U.S.C. 154(b) by 78 days.

(21) Appl. No.: 15/684,619

(22) Filed: Aug. 23, 2017

(65) Prior Publication Data

US 2018/0056706 A1 Mar. 1, 2018

Related U.S. Application Data

(60) Provisional application No. 62/378,459, filed on Aug. 23, 2016.

(51) Int. Cl.

| | |
|---|---|
| ***B43K 8/24*** | (2006.01) |
| ***B43K 8/02*** | (2006.01) |
| ***B43K 8/04*** | (2006.01) |
| ***B43K 24/08*** | (2006.01) |
| *B43K 5/18* | (2006.01) |
| *A46B 11/00* | (2006.01) |

(52) U.S. Cl.

CPC ..... *B43K 8/24* (2013.01); *B43K 8/028* (2013.01); *B43K 8/04* (2013.01); *B43K 24/08* (2013.01); *A46B 11/001* (2013.01); *B43K 5/1845* (2013.01)

(58) Field of Classification Search

CPC ..... B43K 8/028; B43K 3/04; B43K 5/145; B43K 5/16; B43K 5/17; B43K 5/1827; B43K 5/1845; B43K 5/1836; B43K 24/08; B43K 8/24; B43K 8/022; B43K 8/024; B43K 8/04

See application file for complete search history.

(56) References Cited

U.S. PATENT DOCUMENTS

| | | | | |
|---|---|---|---|---|
| 1,523,332 A * | 1/1925 | Wright | ..... | B43K 5/1845 401/206 |
| 2,624,902 A * | 1/1953 | Soldner | ..... | B43K 5/1845 222/501 |
| 2,637,466 A * | 5/1953 | Wright | ..... | B43K 5/1845 222/183 |

(Continued)

*Primary Examiner* — Patrick M. Buechner

(74) *Attorney, Agent, or Firm* — Frijouf, Rust & Pyle P.A.

(57) ABSTRACT

A retractable liquid dispenser device comprising an outer body having a retractable mechanism slidably supporting a liquid dispenser. The liquid dispenser has a supply reservoir and a discharge reservoir with a reservoir valve disposed therebetween. A retractable valve is located in proximity to an open first end of the outer body. A first depression of the retractable actuator opens the retractable valve and moves the liquid dispenser into the extended position for enabling a depression of a distal end of the liquid applicator to open the dispensing valve to permit liquid to flow from the supply reservoir into the dispensing reservoir to dispense the applicator liquid from the distal end of the liquid applicator. A second depression of the retractable actuator moves the liquid dispenser into the retracted position and closes the retractable valve to enclose the distal end of the liquid applicator within the outer body.

12 Claims, 11 Drawing Sheets

(56) References Cited

U.S. PATENT DOCUMENTS 2,643,409 A * 6/1953 Hempel ..... B43K 5/1845 401/206
3,039,436 A * 6/1962 Exner ..... B43K 8/003 401/108
3,113,336 A * 12/1963 Langnickel ..... B43K 5/1845 401/198
3,233,275 A * 2/1966 Hansen ..... B43K 5/1845 401/206
3,468,611 A * 9/1969 Ward ..... B43K 5/1845 401/186
3,525,573 A * 8/1970 Fend ..... B43K 7/12 401/108
3,551,065 A * 12/1970 De Molin ..... B43K 5/1845 401/199
3,628,876 A * 12/1971 Casey ..... B43K 5/1845 401/138
3,945,734 A * 3/1976 Woodbridge ..... A47L 23/05 401/198
4,157,874 A * 6/1979 Durand ..... B43K 5/1845 101/470
4,218,154 A * 8/1980 Erfer ..... B43K 5/005 401/107
4,269,525 A * 5/1981 Melikian ..... B43K 8/003 401/108
4,469,462 A * 9/1984 Hashimoto ..... B43K 5/005 401/107
4,575,271 A * 3/1986 Hashimoto ..... B43K 5/005 401/107
4,618,280 A * 10/1986 Kageyama ..... B43K 7/12 401/107
4,629,348 A * 12/1986 Hashimoto ..... B43K 7/12 401/107
4,711,592 A * 12/1987 Gregory ..... B43K 7/12 401/107
4,859,103 A * 8/1989 Wittek ..... B43K 7/12 401/108
4,911,570 A * 3/1990 Rhoades ..... A45D 34/042 401/107
4,969,764 A * 11/1990 Gregory ..... B43K 8/028 401/107
5,022,773 A * 6/1991 Waldinger ..... B43K 5/17 401/107
5,022,775 A * 6/1991 Inoue ..... A45D 34/043 401/107
6,641,320 B1 * 11/2003 Ballot ..... A45D 34/042 401/198
7,182,541 B1 * 2/2007 Ziniti ..... B43K 5/1845 401/205
2004/0028453 A1 * 2/2004 Kanari ..... B43K 5/17 401/109
2004/0042838 A1 * 3/2004 Lewis, Jr. ..... B43K 5/17 401/108
2004/0265035 A1 * 12/2004 Brand ..... B43K 8/022 401/108
2005/0047844 A1 * 3/2005 Lammers ..... B43K 8/003 401/108
2005/0191111 A1 * 9/2005 Carroll ..... B43K 5/17 401/107
2006/0002755 A1 * 1/2006 Sawa ..... B43K 5/17 401/107
2006/0002757 A1 * 1/2006 Qiu ..... B43K 8/028 401/107
2007/0041775 A1 * 2/2007 Lammers ..... B43K 8/003 401/107
2007/0201940 A1 * 8/2007 Ziniti ..... B43K 5/1845 401/205
2008/0138139 A1 * 6/2008 Kageyama ..... B43K 5/17 401/108
2008/0187389 A1 * 8/2008 Dylkiewicz ..... B43K 5/17 401/108
2010/0247224 A1 * 9/2010 Chang ..... B43K 8/022 401/198
2013/0243514 A1 * 9/2013 Ballot ..... B05C 1/00 401/109

* cited by examiner

RETRACTABLE LIQUID APPLICATOR DEVICE

CROSS-REFERENCE TO RELATED APPLICATIONS

This application claims benefit of U.S. Patent Provisional application No. 62/378,459 filed 23 Aug. 2016. All subject matter set forth in provisional application No. 62/378,459 filed 23 Aug. 2016 is hereby incorporated by reference into the present application as if fully set forth herein.

BACKGROUND OF THE INVENTION

Field of the Invention

This invention relates to the dispensing of liquids and more particularly, this invention relates to an improved retractable liquid applicator device for marking, writing or dispensing a liquid onto a surface.

Background of the Invention

Various types of liquid applicator devices have been devised for dispensing a liquid. Some of these liquid applicator devices were used for dispensing an applicator liquid for writing with ink, dye or paint. Among such devices were fountain pens, ball point pens, felt tip pens as well as other types of liquid applicator devices and the like.

These liquid applicator devices of the prior art have received wide acceptance due in great measure to the convenience of the device. Furthermore, these liquid applicator devices of the prior art had the ability to retain a large quantity of applicator liquid and the ability to supply additional applicator liquid from a liquid container to an applicator at the discretion of the user. In addition, the liquid applicator devices were not limited to the dispensing of only writing liquid such as paints, dyes and the like but are capable of dispensing a large variety of applicator liquids including chemicals, perfumes, lubricants and the like.

Continuing efforts have been made in the past to improve the design of the liquid applicator devices. The improved design of the liquid applicator devices have concentrated on the liquid dispensing mechanism and for improving the communication of the liquid from the liquid container to the applicator tip for dispensing the applicator liquid onto a surface. In one example of a liquid applicator device, an applicator liquid flows into a fiber applicator tip only when the liquid applicator device is held upside down and the fiber applicator tip is depressed by a surface to be coated by the applicator liquid.

U.S. Pat. No. 1,857,467 to Marsh discloses a fountain marker comprising a main reservoir adapted to contain fluid with an end wall for the reservoir having an opening. An auxiliary reservoir is arranged to receive fluid through the opening with a valve opening and closing the discharge outlet. A stem connected to the valve extends through the opening. The fluid is admitted from the main reservoir to the auxiliary reservoir when the valve is closed and is prevented from flowing from the main reservoir to the auxiliary reservoir when the valve is in an open position. A spring holds the valve closed with an applicator tip attached to the valve.

U.S. Pat. No. 2,024,413 to Witt discloses a fountain brush comprising an elongated hollow handle forming a liquid reservoir. A cap is secured to the forward end of the handle having an elongated frusto-conical valve seat and a closure cap on the opposite end of the handle. An elongated conical valve is received in the valve seat. An inwardly projecting stem is formed on the rear end of the valve. The forward end of the valve carries an outwardly projecting shank. A cross-head on the stem having an end is slidably engaged with the inner face of the hollow handle. A contractile coil spring is disposed about the stem having one end anchored to the stem and the other end being anchored in place between the forward cap and handle. A brush-head on the shank and a conical deflector formed on the brush-head are arranged in facing relation to the valve for receiving liquid.

U.S. Pat. No. 2,210,662 to Garvey discloses a writing instrument comprising a reservoir for the writing fluid and a valve tiltable in different directions to control the discharge of fluid from the reservoir. A tiltable tip holder is united with and extends from the tiltable valve with the tiltable tip holder having an internal screw thread. A writing tip is made of a yieldable absorbent material and is screwed into the internal thread to project from the lower end of the tip holder. The writing tip is adjustable longitudinally on the screw thread in response to rotary movements of the tip independently of the tip holder. A means limits the rotary movements of the tip holder and includes a tiltable abutment carried by and tiltable with the united valve and tip holder and a fixed abutment co-operating with the tiltable abutment.

U.S. Pat. No. 2,330,053 to Herb discloses a fountain applicator comprising a fluid containing reservoir and a marking nib and means operable by pressure on the nib in excess of that required for marking therewith for forcing fluid from the reservoir to the nib.

U.S. Pat. No. 3,468,611 to Ward discloses a liquid applicator having a tubular member of flexible side wall construction. A porous applicator nib and valve means control the flow of liquid from the tubular member to the applicator nib.

U.S. Pat. No. 3,484,027 to Micallef discloses a valve closure for dispensing liquids from a container comprising a cap member attached to one end of the container having a centrally located boss member extending towards the interior of the container. An aperture in the boss member and a flange member is spaced from the boss member and adapted to engage the inside of the mouth of the container in sealing relationship. A valve member including a valve stern is mounted for rotation in the boss member. The valve stem has communicating radial and axial openings with an opening in the boss member being adapted to communicate with the radial opening thereby permitting selective opening and closing of the valve closure. A radially resilient extension extends from one end of the valve stem. The extension has portions which are radially compressible to permit assembly of the valve stem member and the boss member. The radially extending portions are adapted to cooperate with the boss member to prevent disassembly of the valve and the boss member, wherein the resilient extension has a semi-circular shape.

U.S. Pat. No. 4,685,820 to Kremer et al. discloses an improved applicator device for applying an applicator material such as a liquid or a flowable solid to a surface. The device comprises a material container and a surface applicator for applying the applicator material to the surface. A valve is interposed between the material container and the surface applicator to permit the flow of applicator material to the surface applicator when the valve is in an open position and to inhibit the flow of applicator material to the surface applicator when the valve is in a closed position. The valve includes a valve closure having an internal closure cavity with a first end being connected to the material container and with a second end defining a surface applicator opening therein. The valve element has a distal end portion that extends through the applicator opening of the valve closure when the valve element is biased into the closed position. The surface applicator comprises the distal end portion of the valve element cooperating with the applicator opening when the distal end portion of the valve element is pressed against the surface thereby forming an annular opening for the flow of the applicator material to apply and disperse the applicator material on the surface. U.S. Pat. No. 4,685,820 to Kremer et al. provided a significant step forward in the art of liquid applicator devices.

U.S. Pat. No. 4,792,252 to Kremer et al. discloses a liquid applicator device for applying a liquid such as paint, a perfume, a chemical, a coating or the like to a surface by writing, marking or painting. The liquid applicator device includes a container for the liquid and an applicator dispensing mechanism. The applicator dispensing mechanism includes an inner subassembly having a valve and an outer subassembly having the surface applicator. The valve regulates the flow of the liquid from the container to the surface applicator. The valve of the applicator device may be opened to allow the liquid to flow from the container to the surface applicator upon depression of the surface applicator or upon depression of a valve actuator. The liquid applicator device incorporates an improved sealing member for sealing with the sides of the surface applicator for reducing the flow of the applicator liquid along the side of the surface applicator. The surface applicator may be in the form of a fiber tip, a brush or similar applicator. The applicator dispensing mechanism may be fabricated independent of the attachment to the container. The valve seal has a flexibly mounted tubular extension which holds the inner end of the surface applicator to maintain the liquid seal during lateral movement of the outer end of the surface applicator.

U.S. Pat. No. 4,976,564 to Fukuoka et al. discloses an implement for applying a liquid comprising a container having an opening at a front end and a front tube attached to the container forward end. A hollow accommodating member has a chamber in an interior and formed with a rearward communication hole and a forward communication hole for holding the chamber in communication with the interior of the container and the interior of the front tube respectively. A liquid feed member is accommodated in the chamber and is movable axially thereof. A biased end valve is disposed inside the front tube to provide a liquid retaining portion inside the front tube around the end valve for closing the forward end opening of the front tube. An applicator having a capillary action extends through the forward end opening of the front tube and is secured to the front end of the end valve.

U.S. Pat. No. 4,984,923 to Ota discloses an operating member inserted in the middle cylinder to be movable backward and forward in the axial direction. A valve mechanism is provided in the front portion of the middle cylinder to supply the pinpoint with the applied liquid stored in the rear portion of the middle cylinder. The valve mechanism includes a valve seat having a valve hole with a valve spindle being provided with a valve element for opening and closing the valve hole and a stretchable member for moving the valve spindle backward and forward. The stretchable member is elongated and shortened in the axial direction of the middle cylinder as the bent portions are bent less and more, respectively. The operating element at the rear end of the middle cylinder is operated to move the operating member forward to push the bent portions of the bent arms to elongate the stretchable member. The valve spindle is moved backward to open the valve hole to supply the applied liquid to the pinpoint.

U.S. Pat. No. 4,993,859 to Assad et al. discloses a liquid applicator including a valve body for insertion into the neck of a liquid container and defining a duct in the valve body. A resilient web is formed integrally with the valve body and extends transversely across the duct. A valve seat is located on one end of the valve body. A valve member is secured to the resilient web and has a valve biased into engagement with the valve seat at the end of the valve body. A coating member is mounted on the opposite end of the valve body. A valve stem on the valve member is located proximate the coating member for being deflected when the coating member is compressed onto an external surface to thereby unseat the valve and permit liquid to flow through the duct onto the coating member.

U.S. Pat. No. 4,913,175 to Yokosuka et al. discloses a liquid-applying tip assembly in which the liquid-applying member is pushed to operate the valve to allow the liquid to flow to the liquid-applying member. The liquid-applying member is a plastic member which comprises a plurality of ribs extending radially and axially from an axial core in such a manner as to form a plurality of axial liquid passageways therebetween. A barrier is provided between the valve and the cylinder of the tip assembly, the barrier having a hole whose diameter is slightly larger than the outside diameter of the liquid-applying member to control the flow of liquid.

U.S. Pat. No. 6,513,681 to Gross et al. discloses a spray dispensing closure including a spray plug and a cap cooperating therewith to selectively occlude passages in the spray plug. A spray plug includes a set of inner passages for conveying product from a dip tube through the spray plug and a set of outer passages for conveying air from a head space in the container. The inner passages communicate with an inner flow space and the outer passages communicate with an outer flow space. A cap cooperates with the spray plug to define an outer chamber and an inner chamber which are isolated from one another when the cap is in the closed position, thereby preventing the mixing of air and product. As the cap is moved to the open position, the cap chambers are permitted to communicate with one another and, as the container is squeezed, a product/air mixture is formed in the closure. A central spray plug post has an upper portion that forms at least one restrictive passage with an inner wall of the cap when the cap is in the open position. As the air/product mixture flows through the restrictive passages, a spray mist is formed and dispensed through at least one dispensing orifice formed in the cap and communicating with the restrictive passages. In an alternative embodiment, only a single set of inner passages are provided on the spray plug and communicate with the head space in the container. A series of dip tube exit passages extend from a proximal end of the dip tube. A plurality of dip tube ends engage ribs extend from the spray plug. When the container is squeezed and the cap is open, product is conveyed from the dip tube and into the inner passages to be mixed with air from the head space.

U.S. Pat. No. 6,634,821 to Gueret discloses a device and system for applying a product, for example, a cosmetic product. The device includes a first compartment containing the product, and a second compartment in flow communication with the first compartment via at least one supply orifice, with the second compartment having an opening which may be removably closed by a closure element. The second compartment forms a housing for an applicator which is insoluble with respect to the product. The applicator may rest against an elastically compressible porous member that may be in flow communication with the supply orifice.

U.S. Pat. No. 6,773,193 to Delage discloses a device for packaging and applying a substance, in particular a cosmetic or a care product, the device comprising a receptacle for containing the substance. The receptacle is provided at the top with an applicator that is permeable to the substance and that has an inside face fed with the substance coming from the receptacle. In the vicinity of the bottom face of the applicator, the device comprises an element that forms an intermediate reservoir that is in permanent communication with the receptacle and that is suitable for retaining a certain quantity of the substance when the device is turned upside-down from a head-up position and is then returned to the head-up position. The intermediate reservoir-forming element are arranged to enable the substance retained in this way to feed the applicator, at least in certain conditions of use of the device.

U.S. Pat. No. 6,817,801 to Colburn et al. discloses an applicator device for applying treatment fluid to various interior surfaces such as those found in an automobile, which is constructed with an applicator head including a housing having a bottom distribution plate and an applicator pad affixed thereto, and which is configured to complementally and releasably receive an associated fluid container.

U.S. Pat. No. 6,817,802 to Nishitani et al. discloses a writing instrument adapted, responsive to a pressure axially applied to a pen core, to supply ink in an ink chamber to the pen core. The writing instrument includes a valve seat disposed between the ink chamber and the pen core. A valve body is operable to be selectively moved between a close position where the valve body is in contact with the valve seat to isolate the pen core from the ink chamber and an open position where the valve body is spaced apart from the valve seat to communicate the pen core with the ink chamber. A pressing spring biases the valve body toward the front end of a pen shaft, and a support member for supporting the valve body and the pressing spring to allow the valve body to be moved in the axial direction. The support member includes a communication channel for communicating the inner space thereof with the ink chamber. The valve body has a channel control portion for allowing the ink flow through the communication channel to be more restricted when the valve body is in the close position that when it is in the open position. The writing instrument can reduce the deposit of ink pigments around the valve body to prevent occurrence of defect in the operation of the valve body.

U.S. Pat. No. 6,945,722 to Colbum et al. discloses a tire applicator for applying treatment fluid to sidewall of a vehicle tire, which is constructed with an applicator head including a dispenser housing having a bottom distribution plate and an applicator pad affixed thereto, and which may be configured to complementally and releasably receive an associated container.

U.S. Pat. No. 7,101,105 to Reggiani discloses a container-applicator for fluid products for cosmetic and pharmaceutical use. An applicator is provided with a spongy-matrix body that is arranged proximate to an opening controlled by a valve element that can be operated from the outside of the container body, the valve element comprising a cap body that can be actuated rotationally in order to pass from a closed position to an open position of the opening and/or vice versa.

U.S. Pat. No. 7,114,871 to Thiebaut discloses a packaging and application device for a product, specifically a cosmetic product. The device includes a receptacle for cleaning the product having a longitudinal axis and a passageway. The receptacle also includes a porous or fibrous applicator element capable of communicating with the product in the receptacle through the passageway. A dispensing element adapted for opening and closing the passageway. The device further contains a dispensing element adapted for opening and closing the passageway and includes a mobile part rotatable about the longitudinal axis between a first position in which the passage is closed and a second position in which the passage is open. The device also includes a closure cap capable of engaging a dispensing element.

U.S. Pat. No. 4,685,820 to Kremer et al. and U.S. Pat. No. 4,792,252 to Kremer et al. and U.S. Pat. No. 6,641,320 provide an improved liquid applicator device that inhibit removal of the applicator tip from the liquid applicator device.

U.S. Pat. No. 8,753,027 to Ballot discloses a liquid applicator device for dispensing an applicator liquid from an applicator liquid container comprising a closure for sealing with the applicator liquid container. A sealing surface is defined in the closure and a valve is disposed within the closure. A spring is located within the closure between a spring retaining step defined in the closure and the valve for biasing the valve into sealing engagement with the sealing surface of the closure for inhibiting the flow of the applicator liquid from the applicator liquid container. A passageway defined in the closure for slidably receiving an applicator tip for engaging with the valve to enable a depression of the applicator tip to displace the valve from the sealing surface of the closure to flow applicator liquid from the applicator liquid container to the applicator tip.

U.S. Pat. No. 8,979,411 to Ballot discloses a liquid applicator comprising a liquid container and a liquid dispensing mechanism having a valve element enabling an axial displacement of an applicator tip to move the valve element into the open position for enabling the applicator tip to apply the liquid to a surface. The improvement comprises an applicator closure having a closure coupling for coupling the applicator closure to a peripheral rim of a container. An optional shield may be secured to the applicator closure for providing protection between the applicator tip and an operator grasping the liquid container.

U.S. Pat. No. 9,211,756 to Ballot discloses a liquid applicator device for applying a liquid from a container to a surface. A closure defining a closure aperture is secured the closure to the container. A sealing member sealingly engages with the closure mounting. The sealing member has a tubular sleeve with an applicator slidably disposed within the tubular sleeve. The applicator comprises a hollow interior with an applicator tip defined by an outer applicator portion of the applicator. A biasing member coacts between the closure and the applicator for urging the applicator to form a seal with the sealing member. A depression of the outer applicator portion against the surface displaces the applicator from the sealing member to enable the flow of the liquid from the container to the applicator tip of the applicator.

U.S. Publication US-2015/0251484-A1 to Ballot et al. discloses a liquid applicator device for dispensing an applicator liquid from an applicator liquid container. The liquid applicator device comprises a closure having an internal passageway for sealing with the applicator liquid container. A dispensing mechanism is disposed in the internal passageway of the closure. An applicator located in the passageway engaging with the valve element for enabling a depression of the applicator to displace the valve element from the sealing surface to enable the dispensing of the applicator liquid from the liquid container into the applicator. A capture extends from the valve element for grasping the applicator for inhibiting removal of the applicator from the passageway.

U.S. Pat. No. 9,346,072 to Ballot discloses a precision liquid applicator for dispensing an applicator liquid from a container onto a surface. The precision liquid applicator comprises a closure defining a terminal orifice and a valve seat. A valve comprises a precision applicator tip extending through the terminal orifice and comprises a valve seal for sealing with the valve seat. A depression of the precision applicator tip onto the surface displaces the valve seal from the sealing surface for providing an annular passageway between the precision applicator tip and the terminal orifice to enable the flow of the applicator liquid onto the surface. A valve stop cooperates with a stop wall for limiting movement of the valve to control a cross-sectional area of the passageway between the precision applicator tip and the terminal orifice and for ensuring the precision applicator tip extends beyond the second end of the closure. The precision liquid applicator is suitable for applying paint into a scratch within a painted surface without excessive application of paint outside of the scratch.

Although the inventions of Kremer and Ballot have met with substantial commercial success in various fields of application, the inventions of Kremer and Ballot require two hands for removing the protective cap from the liquid applicator device. Thereafter the liquid applicator devices could be operated with the single-handed operation.

It is an object of the present invention is to improve upon inventions of Kremer and Ballot and provide an improved retractable liquid dispenser device that eliminates the need for two-handed operation in removing the protective cap from the liquid applicator device.

Another object of the present invention is to provide a retractable liquid dispenser device that is adaptable for dispensing a wide variety of liquids such as lubricants, paints, stains, solder fluxes and the like.

The foregoing has outlined some of the more pertinent objects of the present invention. These objects should be construed as being merely illustrative of some of the more prominent features and applications of the invention. Many other beneficial results can be obtained by modifying the invention with in the scope of the invention. Accordingly other objects in a full understanding of the invention may be had by referring to the summary of the invention and the detailed description describing the preferred embodiment of the invention.

SUMMARY OF THE INVENTION

The present invention is defined by the appended claims with the specific embodiments shown in the attached drawings. For the purpose of summarizing the invention, the invention comprises an improved retractable liquid dispenser device, comprising an outer body having an internal channel communicating between a first and a second end. A liquid dispenser has a supply reservoir and a discharge reservoir with a valve disposed therebetween. A retractable mechanism is slidably supporting the liquid dispenser within the outer body.

A retractable valve is located in proximity to an end of the outer body. A first depression of the retractable actuator opens the retractable valve and moves the liquid dispenser into the extended position for enabling a depression of the distal end of the liquid applicator to open the dispensing valve to permit liquid to flow from the supply reservoir into the dispensing reservoir to dispense the applicator liquid from the distal end of the liquid applicator. A second depression of the retractable actuator moves the liquid dispenser into the retracted position and closes the retractable valve to enclose the distal end of the liquid applicator within the outer body.

In one embodiment of the invention, a dispensing valve spring biases the dispensing valve into a closed position and a retractable spring biases the liquid dispenser into a retracted position. Preferably, the retractable valve is located in proximity to the second end of the outer body and cooperates with the retractable actuator through the liquid dispenser. The retractable valve encloses the distal end of the liquid applicator within the outer body for inhibiting evaporation of the applicator liquid from the distal end of the liquid applicator. The retractable actuator is located in proximity to the first end of the outer body.

In another embodiment of the invention, the liquid dispenser comprises an inner body extending between a first and a second end. The first end of the inner body supports the liquid applicator. The retractable actuator is secured to the first end of the inner body. A dispensing valve sub-assembly comprising the dispensing valve and the dispensing valve spring and the discharge reservoir and the liquid applicator is secured within the inner body for defining the supply reservoir between the dispensing valve sub-assembly and the second end of the inner body.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments maybe modifying for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
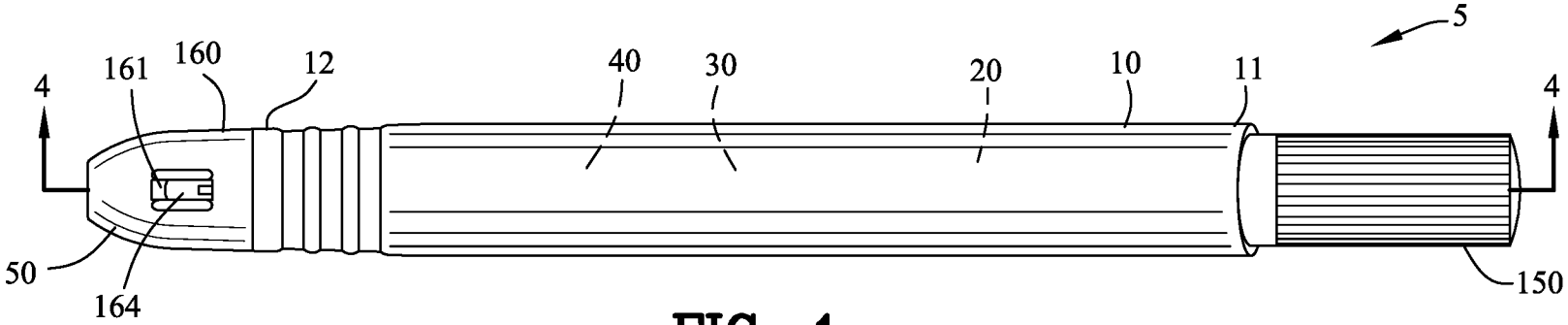
FIG. 1 is a top view of a retractable liquid dispenser device of the present invention.
Figure 2:
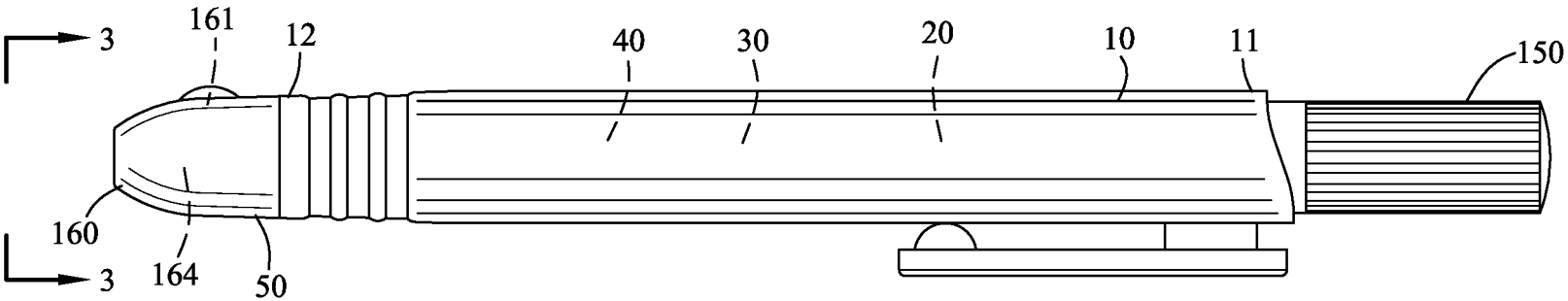
FIG. 2 is a side view of the retractable liquid dispenser device of FIG. 1.
Figure 3:
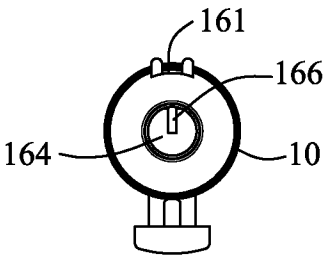
FIG. 3 is a view along line 3-3 in FIG. 2.
Figure 4:
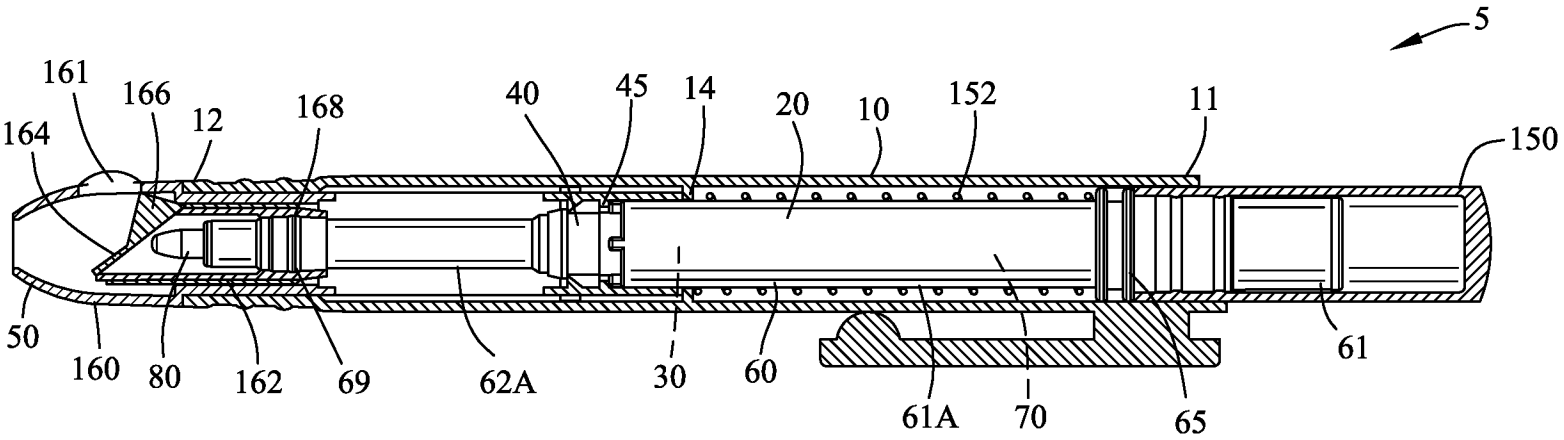
FIG. 4 is a sectional view along line 4-4 in FIG. 1.
Figure 5:
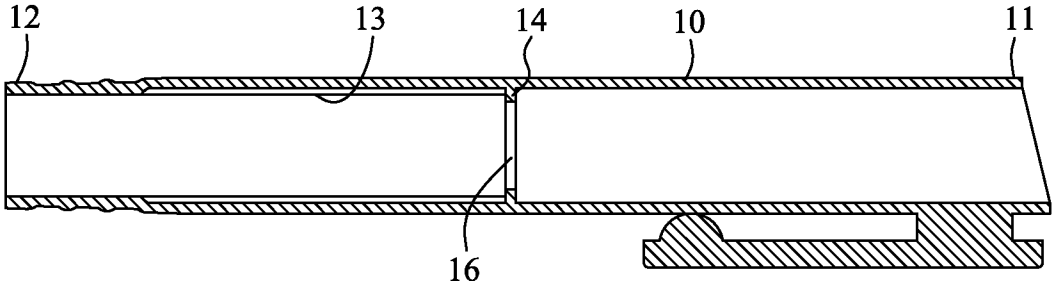
FIG. 5 is a view of an outer body of FIG. 4.
Figure 6:
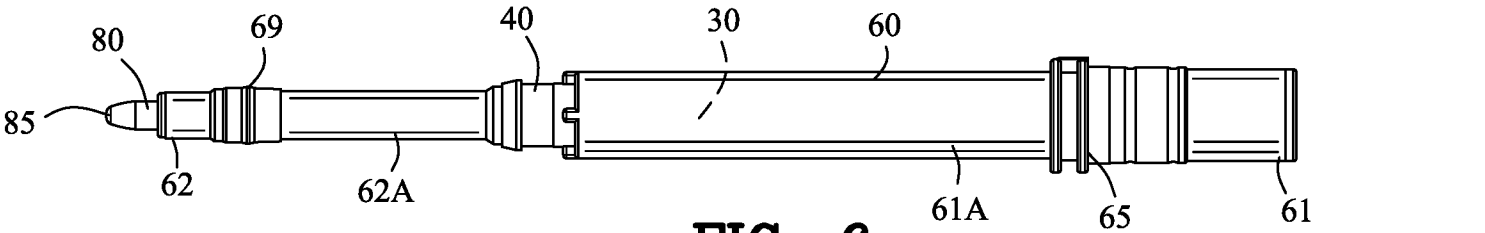
FIG. 6 is a side view of a liquid dispenser slidably mounted within the retractable liquid dispenser device of FIG. 5.
Figure 7:
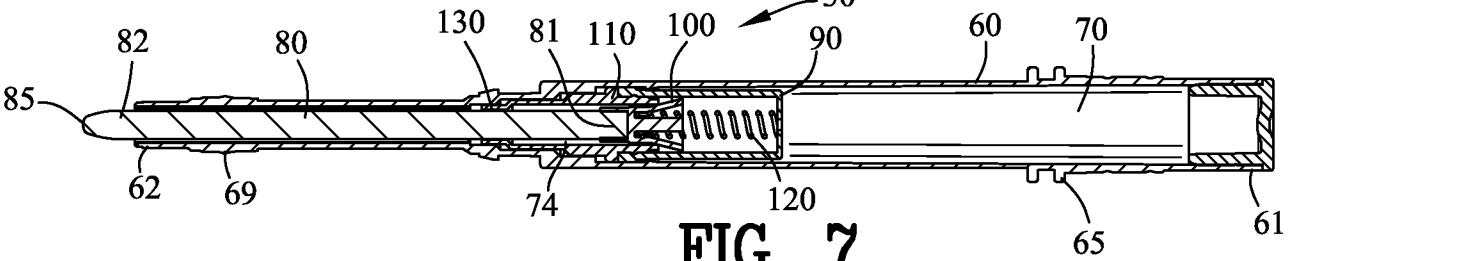
FIG. 7 is a side sectional of FIG. 6.
Figure 8:
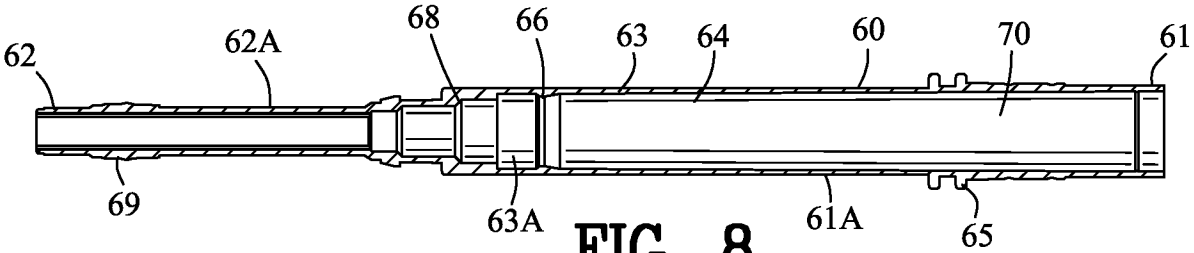
FIG. 8 is a side sectional view of a portion of FIG. 7 illustrating the inner body of the liquid dispenser.

FIGS. 1-5 illustrate a retractable liquid dispenser device 5 of the present invention. The retractable liquid dispenser device 5 is suitable for dispensing an applicator liquid 6 onto a surface. The retractable liquid dispenser device 5 comprises an outer body 10, a liquid dispenser 20 having a dispensing valve 30, a retractable mechanism 40 and a retractable valve assembly 50.

The retractable liquid dispenser device 5 differs from the prior art retractable pens, markers and the like through the incorporation of the dispensing valve 30 for controlling the flow of the applicator liquid from the retractable liquid dispenser device 5. The dispensing valve 30 permits the dispensing a wide variety of applicator liquids such as paints, solder fluxes, lubricants and the like that are not dispensed by the retractable pens and markers of the prior art.

The retractable liquid dispenser device 5 comprises an outer body 10 having a first and a second open end 11 and 12. An internal channel 13 communicates between the open first and second ends 11 and 12. An annular stop wall 14 having a central opening 16 is secured between the open first and second ends 11 and 12.

FIGS. 6-11 illustrate the liquid dispenser 20 of the retractable liquid dispenser device 5. The liquid dispenser 20 comprises an inner body 60 extending between a first end 61 and a second end 62. A sidewall 63 defines an internal passageway 64 communicating between the first and second ends 61 and 62. The inner body 60 defines a first end portion 61A and a second end portion 62A adjacent to the first and second ends 61 and 62. An intermediate portion 63A is located between the first and second end portions 61A and 62A.

A major external annular projection 65 extends from an outer surface of the sidewall 63 in proximity to the first end 61 of the inner body 60. An internal annular projection 66 extends from an inner surface of the sidewall 63. A shoulder 68 is formed in the inner surface 64 of the intermediate portion 63A the function of which will be described in greater detail hereinafter. A minor external annular projection 69 extends from an outer surface of the sidewall 63 in proximity to the second end 62 of the inner body 60.

The first end portion 61A of the inner body 60 is adapted to slidably receive a liquid applicator 80. The second end portion 62A of the inner body 60 is adapted to store the applicator liquid 6 in a supply reservoir 70. The intermediate portion 63A of the inner body 60 is adapted to receive the dispensing valve 30. An interlock 72 secures the dispensing valve 30 within the inner body 60. The dispensing valve 30 defines a discharge reservoir 74.

Figure 9:
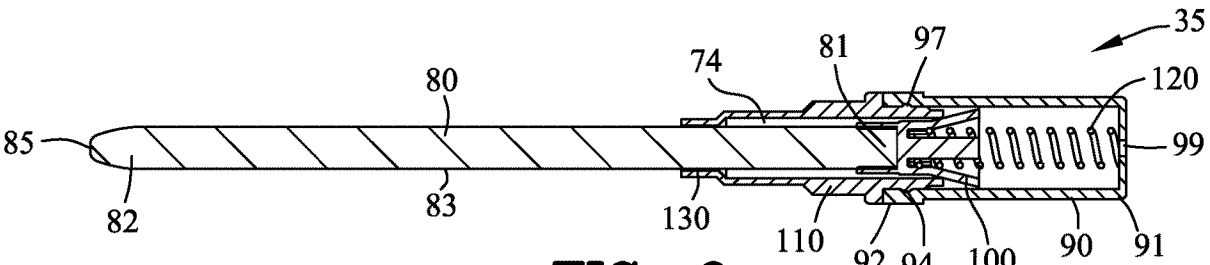
FIG. 9 is a side sectional view of a portion of FIG. 8 illustrating a dispensing valve sub-assembly.

As best shown in FIG. 9, the applicator 80 extends between an proximal end 81 and an distal end 82. The applicator 80 is a generally cylindrically shaped member defining a cylindrical diameter 83 between the proximal end 81 and the distal end 82. The applicator 80 may formed from a felt fiber, solid or a brush construction.

In this example of the invention, the applicator 80 is formed of a highly compacted fibrous material such as polyester or other similar material having analogous properties sufficient to hold the original shape when moistened with the applicator liquid 6 but adequate to pass the applicator liquid 6 from the proximal end 81 to the distal end 82 of the applicator 80 by capillary action. In the alternative, the applicator 80 may be a non-porous material with grooves extending longitudinally along an outer surface of the applicator 80.

Figure 10:
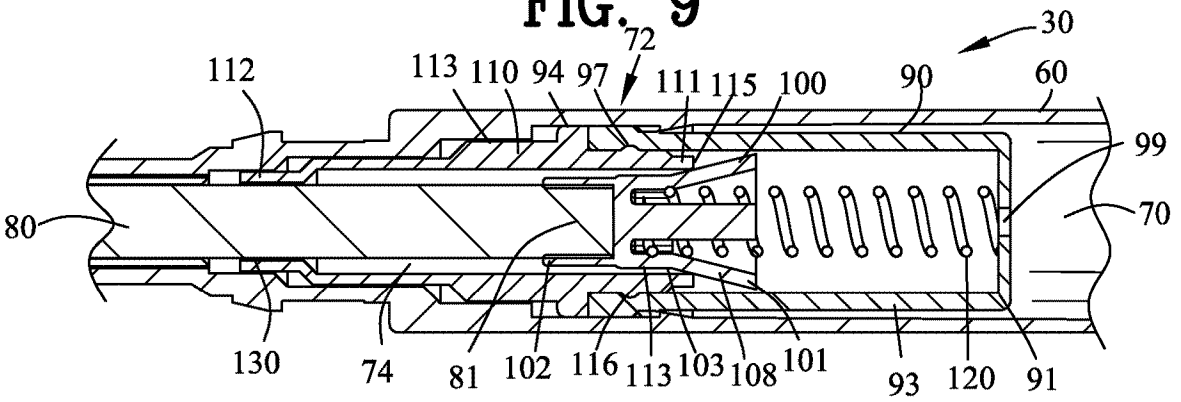
FIG. 10 is an enlarged side sectional view of a portion of FIG. 8 illustrating the dispensing valve sub-assembly in a closed position.
Figure 11:
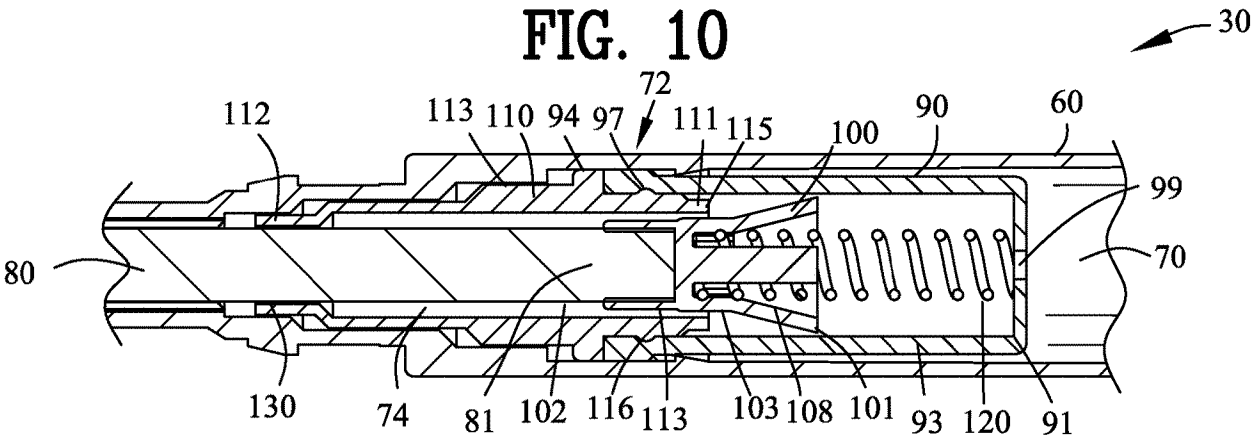
FIG. 11 is a view similar to FIG. 10 illustrating the dispensing valve sub-assembly in an open position.

FIGS. 9-11 illustrate the dispensing of the retractable liquid dispenser device 5. The dispensing valve 30 includes a valve body 90, a valve element 100, a valve seal 110, a spring 120 and a tubular seal 130. The valve body 90, the valve element 100, the valve seal 110, the spring 120 and the tubular seal 130 forms a sub-assembly 140.

The valve body 90 extends between a valve body inner end 91 and a valve body outer end 92 as a cylindrical sidewall 93. The valve body inner end 91 comprises a face having vents whereas the valve body outer end 92 comprises an opening. A valve body shoulder 94 is formed on the valve body outer end 92 of the valve body 90. The valve body shoulder 94 engages the internal annular projection 66 for affixing the valve body 90 to the inner body 60.

An inner body hollow 97 is defined in the outer end 92 of the valve body 90. The valve body 90 is provided with a hole 99 defined within the valve body inner end 91 of the valve body 90. The hole 99 and vents on the inner end 91 of the valve body 90 facilitates the flow of the applicator liquid 6 into the valve body 90.

The valve element 100 extends between a valve element inner end 101 and a valve element outer end 102. The valve element 100 defines a circumferential sidewall 103 supporting a flared peripheral shoulder 108. The outside diameter of the flared peripheral shoulder 108 is less than the inner diameter of the valve body 90 for enabling the valve element 100 to move within the valve body 90.

The valve seal 110 includes a valve seal inner end 111 and a valve seal outer end 112 with a cylindrical sidewall 113 terminating in a sealing surface 115. The valve seal 110 is press fit into the valve body 90 with the valve element 100 and the spring 120 located therebetween. The inner body hollow 97 of the valve body 90 receives an valve seal annular bulge 116 of the valve seal 110 for interlocking the valve seal 110 within the valve body 90.

The outside diameter of the flared peripheral shoulder 108 of the valve element 100 is less than the inner diameter of the valve body 90 enabling the valve element 100 to move within the valve body 90. The outside diameter of the flared peripheral shoulder 108 of the valve element 100 is greater than the inner diameter of the valve seal inner end 111 of the valve seal 110 for enabling valve element 100 to form a seal with the sealing surface 115.

A tubular seal 130 extends from the valve seal as a one-piece molding. The tubular seal 130 provides a sliding seal with the cylindrical diameter 83 of the applicator 80. The proximal end 81 of the applicator 80 is in direct engagement with the outer end 102 of the valve element 100.

The space between the cylindrical diameter 83 of the applicator 80 and the tubular seal 130 defines the discharge reservoir 74 for supplying applicator liquid 6 to the proximal end 81 of the applicator 80

FIG. 10 illustrates the dispensing valve 30 biased into a closed position by the dispensing spring 120. When the dispensing valve 30 in the closed condition, the flared peripheral shoulder 108 of the valve element 100 is biased by the dispensing spring 120 into engagement with the valve seal inner end 111 of the valve seal 110. The engagement of the flared peripheral shoulder 108 with the valve seal inner end 111 prevents the passage of the applicator liquid 6 from the supply reservoir 70 into the discharge reservoir 74.

FIG. 11 illustrates the dispensing valve 30 in an open position upon depression of the applicator 80. A depression of the applicator 80 against a surface will compress the dispending spring 120 and move the flared peripheral shoulder 108 of the valve element 100 from the valve seal inner end 111 for enabling the passage of the applicator liquid 6 from the supply reservoir 70 into the discharge reservoir 74. The applicator liquid 6 moves from the proximal end 81 to the distal end 82 of the applicator 80 by capillary action. The applicator liquid 6 at the applicator 80 may be transferred to a surface by marking, dabbing or a brushing action.

Referring back to FIG. 4, the retractable mechanism 40 including the central opening 16 in the annular stop wall 14 slidably supports the liquid dispenser 20 within the outer body 10. The liquid dispenser 20 is introduced into the internal channel 13 of the outer body 10 through the first end of the outer body 10.

The retractable mechanism 40 includes a bi-stable cam system 45 for retaining the liquid dispenser in either a retracted position or an extended position. The operation of various bi-stable cam systems commonly referred to as a "click pen" is well known in the art as evidenced by U.S. Pat. Nos. 3,205,863 and 3,819,282.

A retractable actuator 150 is affixed to the first end 61 of the inner body 60. A retractable spring 152 is disposed between the annular stop wall 14 and the major external annular projection 65 for biasing the liquid dispenser 20 into a retracted position within the outer body 10. As will be described in greater detail hereinafter, the retractable actuator 150 moves the liquid dispenser 20 between a retracted position and an extended position.

The retractable valve assembly 50 includes an outer retractable valve body 160 secured to the second end 12 of the outer body 10. A through slot 161 is defined within the outer retractable valve body 160. An angular truncated cylinder 162 is slidable mounted within the outer retractable valve body 160. The angular truncated cylinder 162 pivotably supports a retractable valve 164 shown as a flapper valve. The retractable valve 164 includes an extension 166 extending from the retractable valve 164.

The retractable valve assembly 50 cooperating with the retractable actuator 150 for opening and closing the retractable valve 164. The angular truncated cylinder 162 includes a coupling 168 for engaging with the minor external annular projection 69 located on the inner body 60.

FIGS. 12-15 illustrate the retractable liquid dispensing device 5 in various operating positions. The improved retractable liquid dispenser device 5 eliminates the need for two-handed operation in removing the protective cap from valve operated liquid applicator devices of the prior art.

Figure 12:
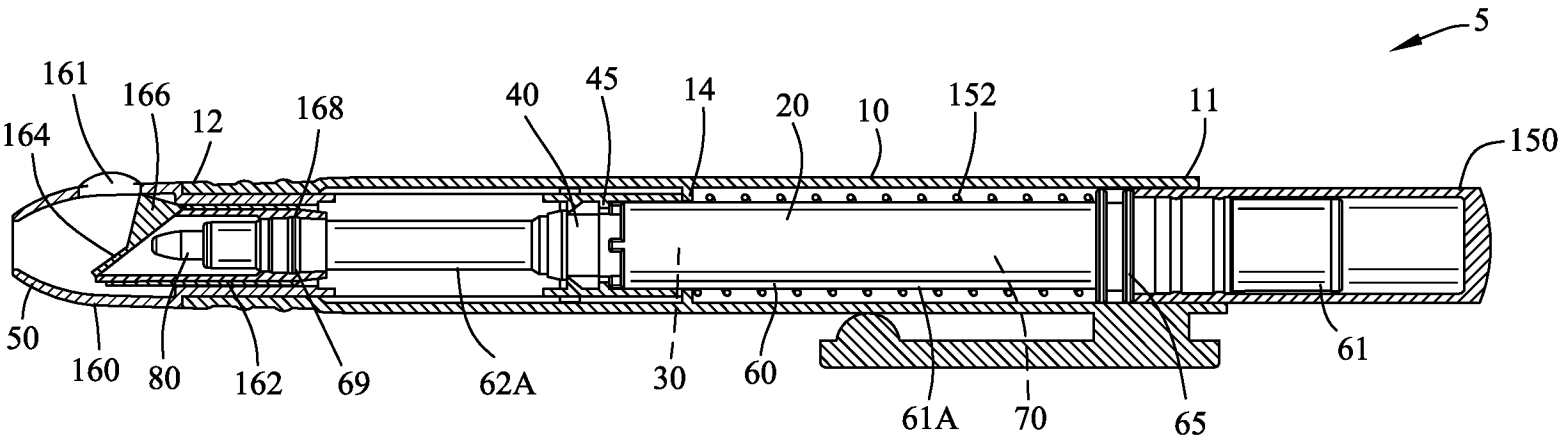
FIG. 12 is a side view of the retractable liquid dispenser device of FIG. 2 with the retractable valve in a closed position.

FIG. 12 is a side view of the retractable liquid dispenser device 5 with the retractable valve 164 in a closed position. The bi-stable cam system 45 maintains the liquid dispenser within the outer body 10. The retractable valve 164 is held in the closed position by the coupling 168 for inhibiting evaporation of the applicator liquid 6 from the distal end 82 of the liquid applicator 80.

Figure 13:
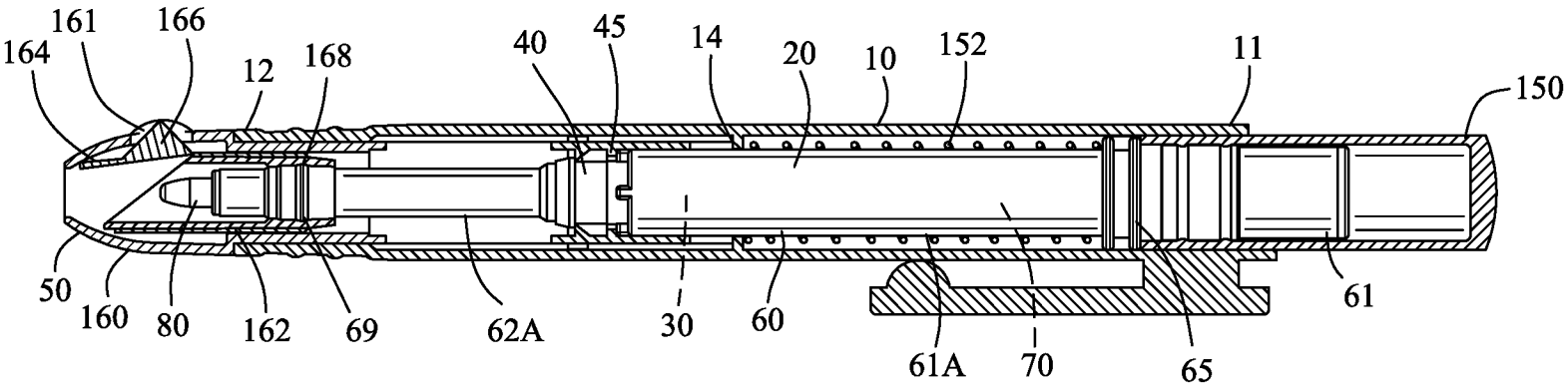
FIG. 13 is a side view similar to FIG. 12 with the retractable valve in an open position.

FIG. 13 is a side view similar to FIG. 12 with the retractable valve 164 in an open position. A partial depression of the retractable actuator 150 moves the liquid dispenser 20 forward relative to the outer body 10 against the urging of the retractable spring 152. Concomitantly therewith, the liquid dispenser 20 opens the retractable valve 164 by sliding the angular truncated cylinder 162 forward through the coupling 168. The extension 166 extending from the retractable valve 164 is received within the slot 161 defined within the outer retractable valve body 160.

Figure 14:
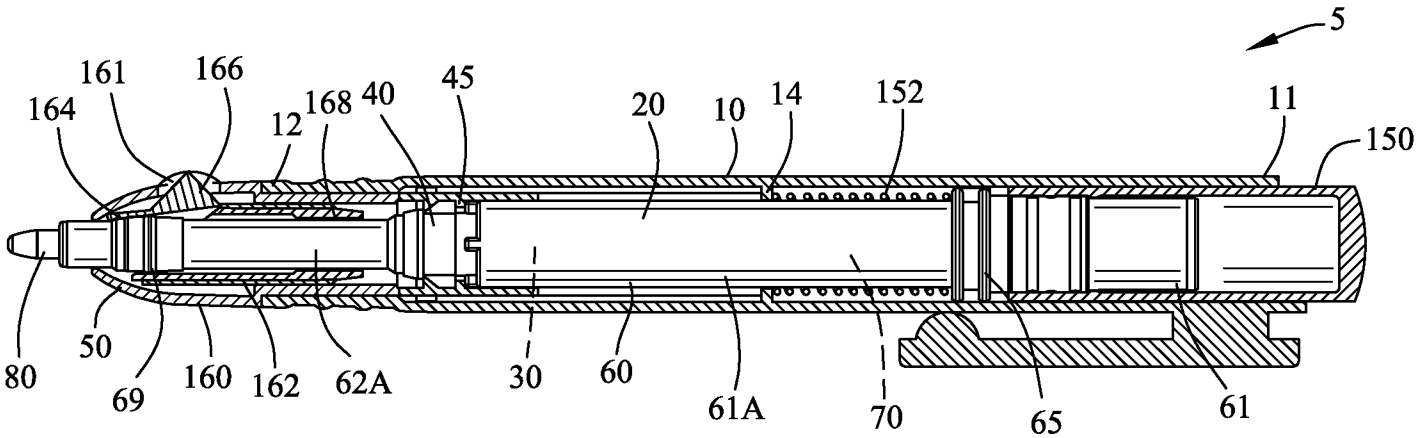
FIG. 14 is a side view similar to FIG. 13 with the retractable valve in an open position and the liquid dispenser located in an extended position.

FIG. 14 is a side view similar to FIG. 13 with the retractable valve 164 in an open position and the liquid dispenser 20 located in an extended position. A continued depression of the retractable actuator 150 moves the liquid dispenser 20 forward relative to the outer body 10 against the urging of the retractable spring 152 until the bi-stable cam system 45 of the retractable mechanism 40 locks the liquid dispenser 20 in the extended position. The liquid dispenser 20 is now in position to dispense the applicator liquid 6 as will be further illustrated in FIGS. 16 and 17.

Figure 15:
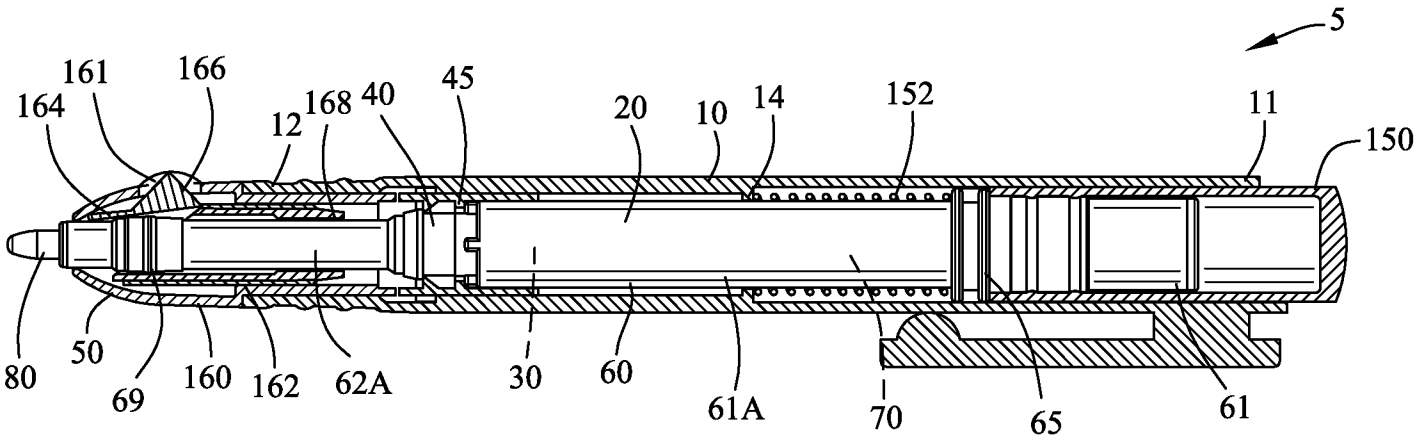
FIG. 15 is a side view similar to FIG. 14 with the retractable valve in an open position and the liquid dispenser located in an extended position and with the liquid applicator in a depressed position to dispense the applicator from a distal end of the liquid applicator.

FIG. 15 is a side view similar to FIG. 14 with the retractable valve 164 in an open position and the liquid dispenser 20 located in an extended position and with the liquid applicator 80 in a depressed position to dispense the applicator liquid 6 from a distal end 82 of the liquid applicator 80.

A second depression of the retractable actuator 150 moves the liquid dispenser 20 into the retracted position by the urging of the retractable spring 152. The retraction of the liquid dispenser 20 closes the retractable valve 164 by sliding the angular truncated cylinder 162 backward by the coupling 168. The extension 166 extending from the retractable valve 164 engages the outer retractable valve body 160 to close the retractable valve 164. The closing of the retractable valve 164 inhibits evaporation of the applicator liquid from the distal end of the liquid applicator.

Figure 16:
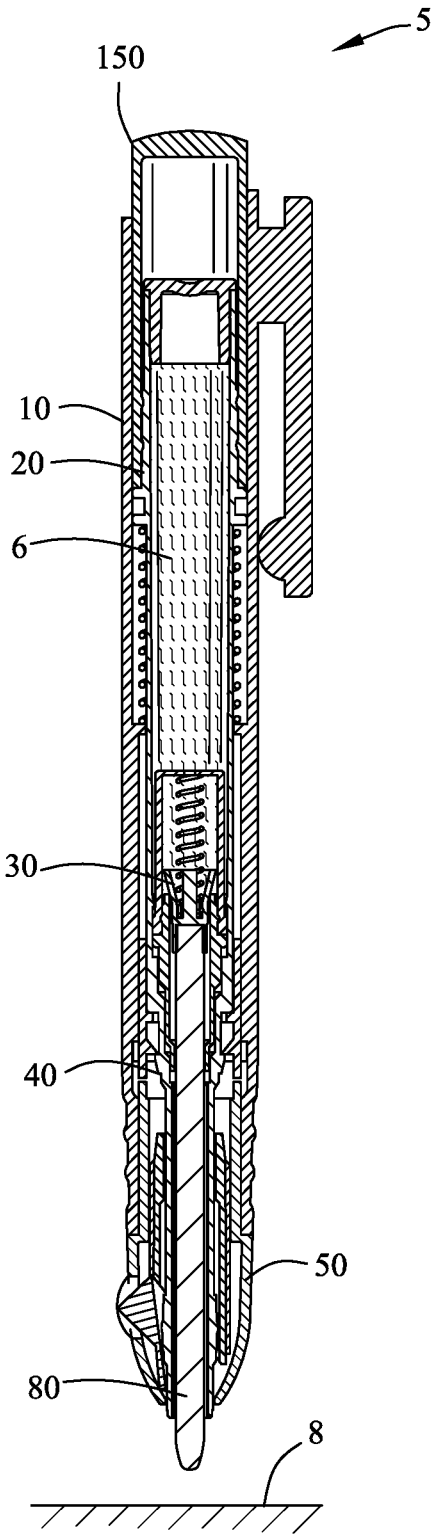
FIG. 16 is a side sectional view of the retractable liquid dispenser device illustrating a dispensing valve is a closed position for inhibiting the flow of the applicator liquid from the supply reservoir.

FIG. 16 is a side sectional view of the retractable liquid dispenser device 5 of FIG. 14 positioned above a surface 8 illustrating a dispensing valve 30 is a closed position for inhibiting the flow of the applicator liquid 6 from the supply reservoir 70.

Figure 17:
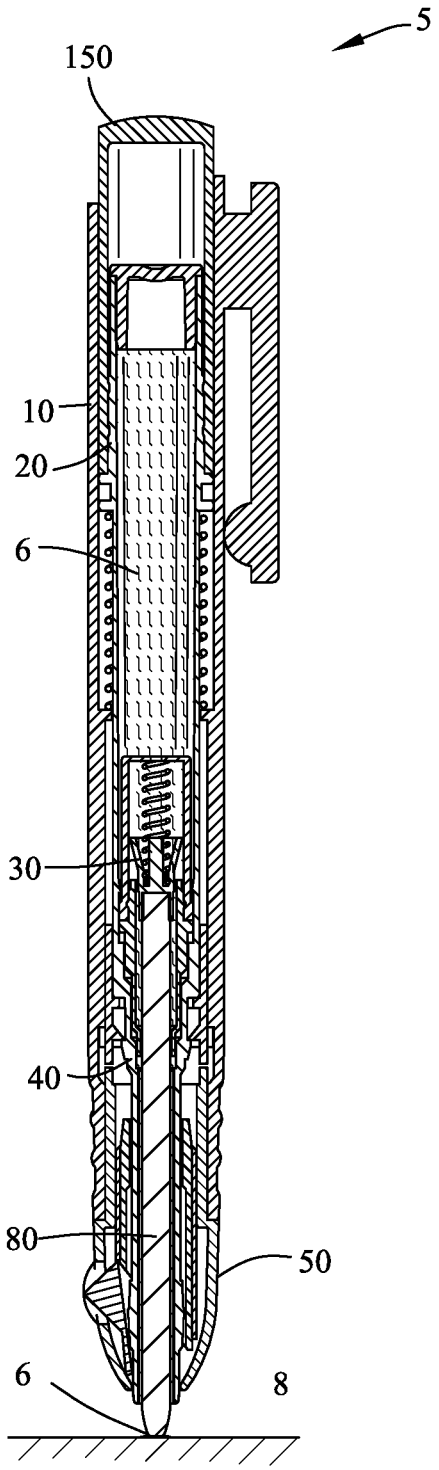
FIG. 17 is a side sectional view similar to FIG. 16 illustrating the dispensing valve is an open position for permitting the liquid to flow from the supply reservoir into the dispensing reservoir to dispense the applicator liquid from the distal end of the liquid applicator.
Figure 18:
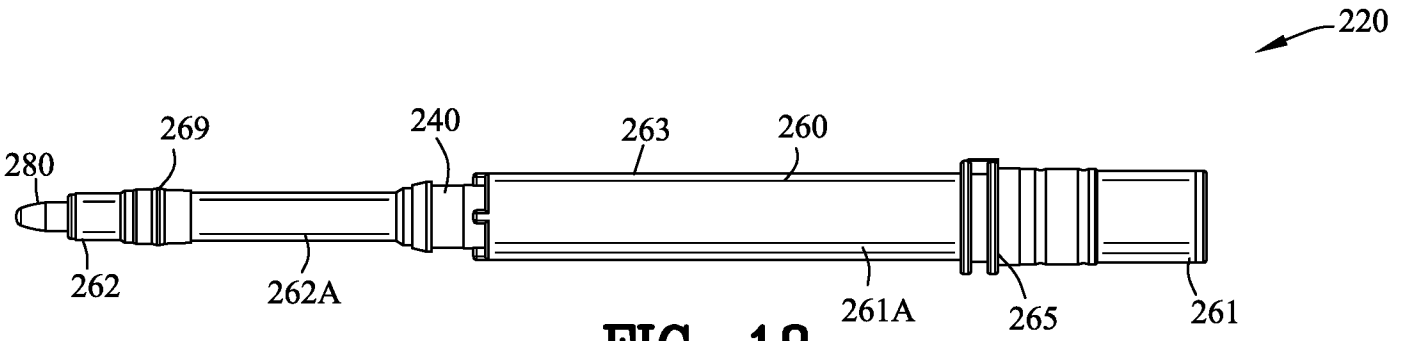
FIG. 18 is a side view of a second embodiment of a liquid dispenser slidably mounted within the retractable liquid dispenser device of FIG. 5.
Figure 19:
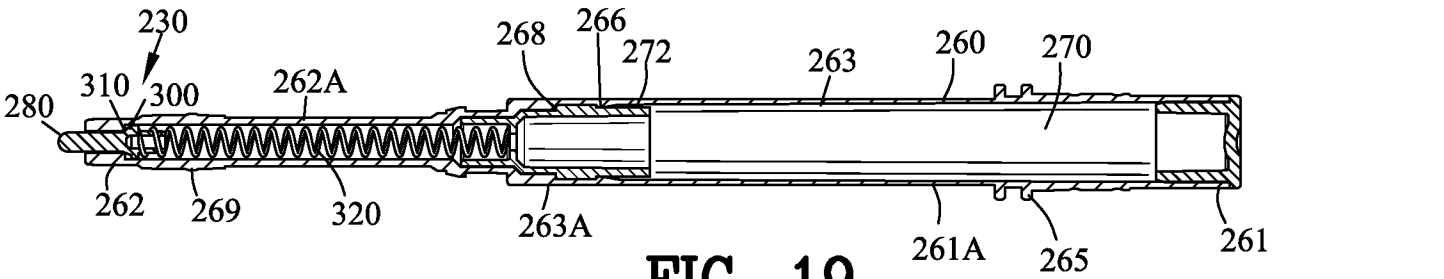
FIG. 19 is a side sectional of FIG. 18.
Figure 20:
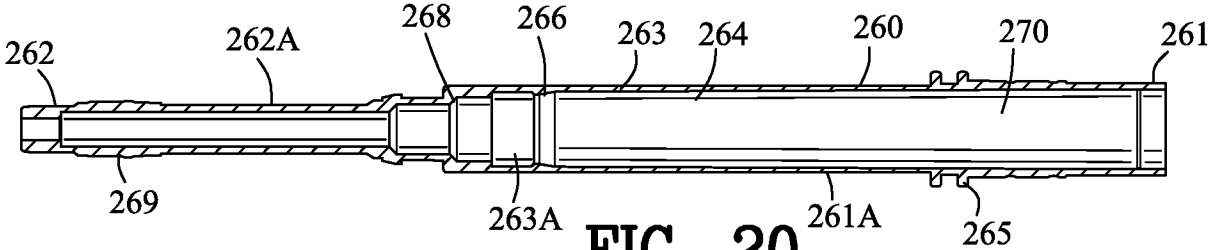
FIG. 20 is a side sectional view of a portion of FIG. 19 illustrating the inner body of the liquid dispenser.

FIG. 17 is a side sectional view similar to FIG. 16 illustrating the dispensing valve 30 in an open position for permitting the liquid to flow from the supply reservoir 70 into the dispensing reservoir 74 to dispense the applicator liquid 6 from the distal end 82 of the liquid applicator 80.

FIGS. 18-22 illustrate a second embodiment of the liquid dispenser 220 of the retractable liquid dispenser device 5. The liquid dispenser 220 comprises an inner body 260 extending between a first end 261 and a second end 262. A sidewall 263 defines an internal passageway 264 communicating between the first and second ends 261 and 262. The inner body 260 defines a first end portion 261A and a second end portion 262A adjacent to the first and second ends 261 and 262. An intermediate portion 263A is located between the first and second end portions 261A and 262A.

The liquid dispenser 220 has an identical outer surface as the liquid dispenser 20 shown in FIGS. 6-11. A major external annular projection 265 extends from an outer surface of the sidewall 263 in proximity to the first end 261 of the inner body 260. A minor external annular projection 269 extends from an outer surface of the sidewall 63 in proximity to the second end 262 of the inner body 260.

Figure 21:
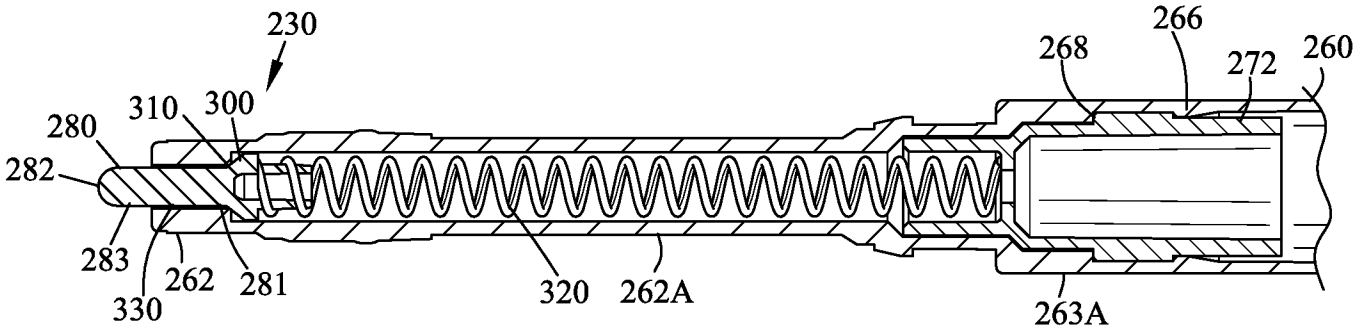
FIG. 21 is an enlarged side sectional view of a portion of FIG. 19 illustrating the dispensing valve in a closed position.
Figure 22:
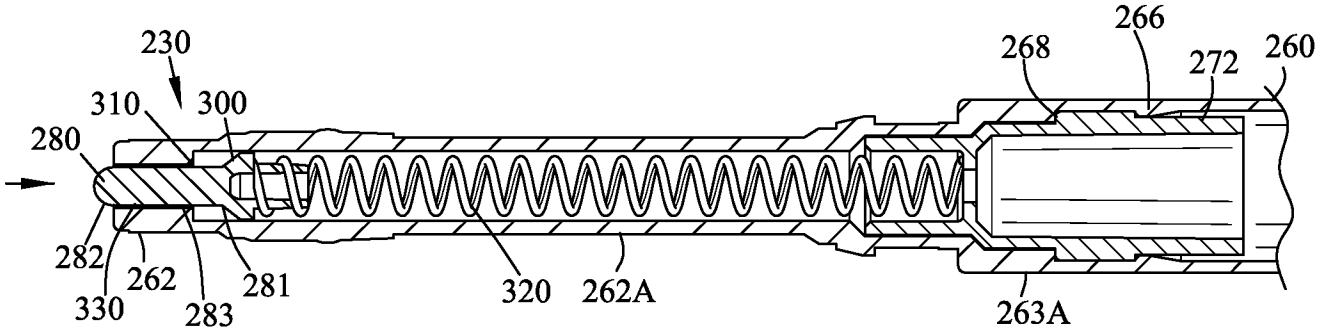
FIG. 22 is a view similar to FIG. 21 illustrating the dispensing valve in an open position.
Figure 23:
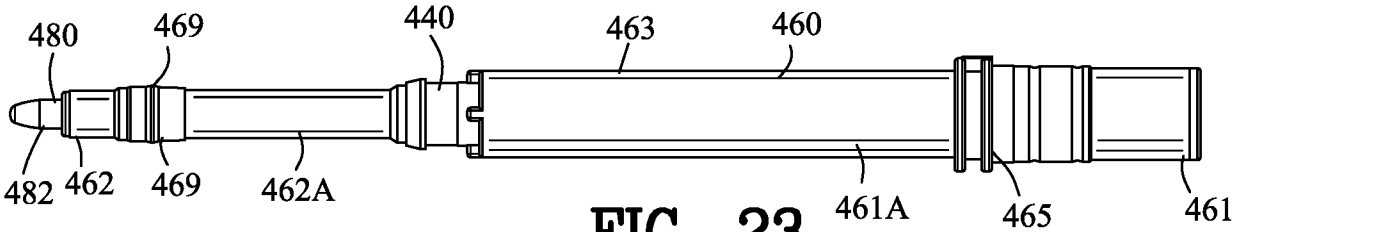
FIG. 23 is a side view of a third embodiment of a liquid dispenser slidably mounted within the retractable liquid dispenser device of FIG. 5.
Figure 24:
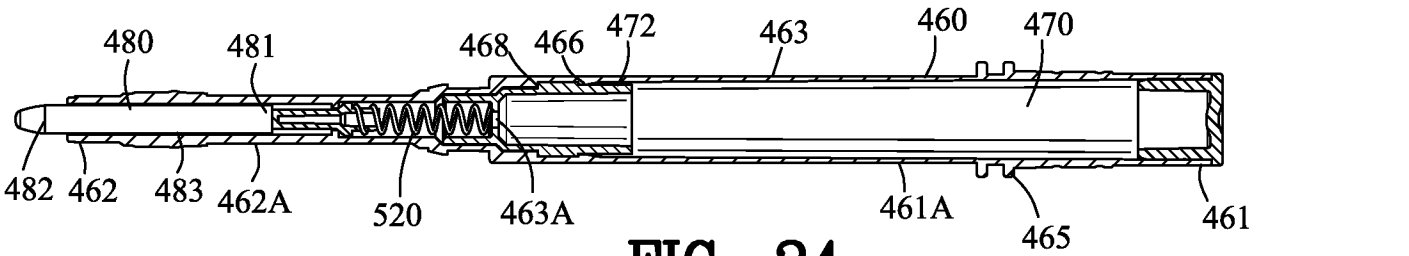
FIG. 24 is a side sectional of FIG. 23.
Figure 25:
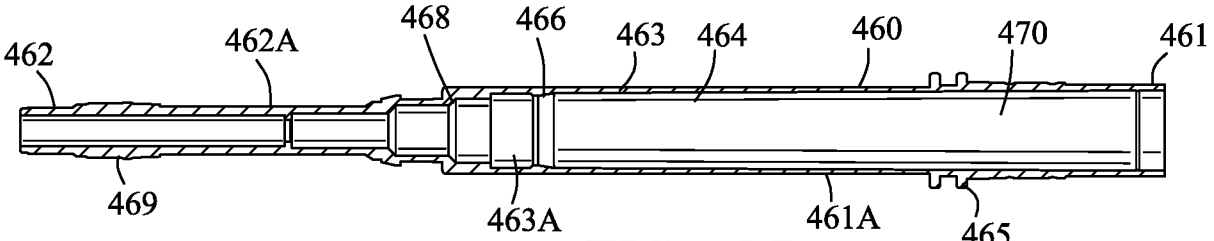
FIG. 25 is a side sectional view of a portion of FIG. 24 illustrating the inner body of the liquid dispenser.

As best shown in FIGS. 21 and 22, an internal annular projection 266 extends from an inner surface of the sidewall 263. A shoulder 268 is formed in the inner surface 264 of the intermediate portion 263A. The tip of the first end portion 261A of the inner body 260 is adapted to slidably receive a combined liquid applicator 280 and the dispensing valve 230. The second end portion 262A of the inner body 260 is adapted to store the applicator liquid 6 in a supply reservoir 270. An interlock 272 secures the liquid applicator 280 and the dispensing valve 230 within the tip of the first end portion 261A of the inner body 60.

As best shown in FIG. 21, the applicator 280 extends between a proximal end 281 and a distal end 282. The applicator 280 is a generally cylindrically shaped member defining a cylindrical diameter 283 between the proximal end 281 and the distal end 282. In this example of the invention, the applicator 280 is formed of a non-porous material.

FIGS. 21-22 illustrate dispensing valve 230 including a valve element 300, a valve seal 310, a spring 320 and a tubular seal 330. The interlock 272 engages the internal annular projection 266 and the shoulder 268 for affixing the liquid applicator 280 and the dispensing valve 230 within the inner body 260. The outside diameter of the valve element 300 is greater than the inner diameter of the valve seal 310 for enabling valve element 300 to form a seal.

A tubular seal 330 extends from the valve seal 310 as a one-piece molding. The tubular seal 330 allows a sliding movement with the cylindrical diameter 283 of the applicator 280. The space between the cylindrical diameter 283 of the applicator 280 and the tubular seal 330 for supplies applicator liquid 6 to the applicator 280.

FIG. 21 illustrates the dispensing valve 330 biased into a closed position by the dispensing spring 320. When the dispensing valve 330 in the closed condition, the valve element 300 is biased by the dispensing spring 320 into engagement with the valve seal 310.

FIG. 22 illustrates the dispensing valve 230 in an open position upon depression of the applicator 280. A depression of the applicator 280 against a surface will compress the dispending spring 320 and move the valve element 300 from the valve seal 310 for enabling the passage of the applicator liquid 6 from the supply reservoir 270 to the distal end 282 of the applicator 280. The applicator liquid 6 at the applicator 280 may be transferred to a surface by marking, dabbing or a brushing action.

FIGS. 23-27 illustrate a third embodiment of the liquid dispenser 420 of the retractable liquid dispenser device 5. The liquid dispenser 420 comprises an inner body 460 extending between a first end 461 and a second end 462. A sidewall 463 defines an internal passageway 464 communicating between the first and second ends 461 and 462. The inner body 460 defines a first end portion 461A and a second end portion 462A adjacent to the first and second ends 461 and 462. An intermediate portion 463A is located between the first and second end portions 461A and 462A.

The liquid dispenser 420 has an identical outer surface as the liquid dispenser 20 shown in FIGS. 6-11. A major external annular projection 465 extends from an outer surface of the sidewall 463 in proximity to the first end 461 of the inner body 460. A minor external annular projection 469 extends from an outer surface of the sidewall 63 in proximity to the second end 462 of the inner body 460.

Figure 26:
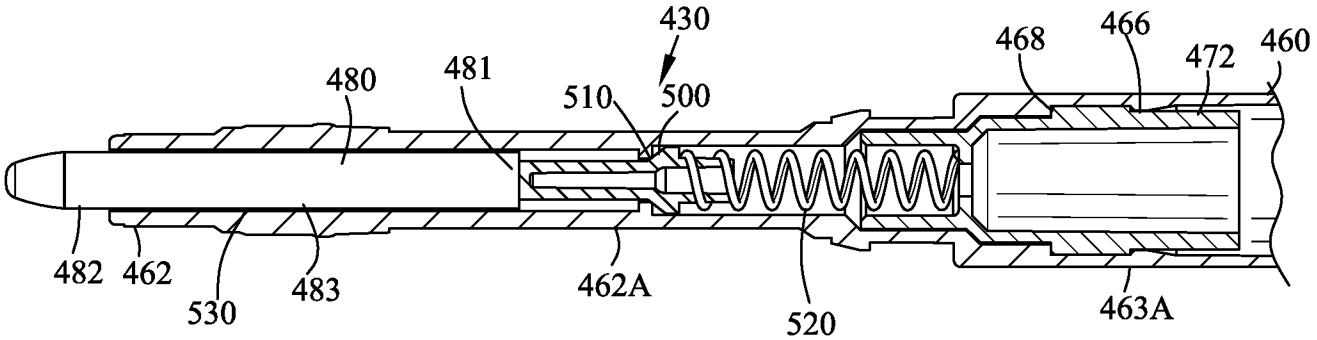
FIG. 26 is an enlarged side sectional view of a portion of FIG. 24 illustrating the dispensing valve in a closed position.
Figure 27:
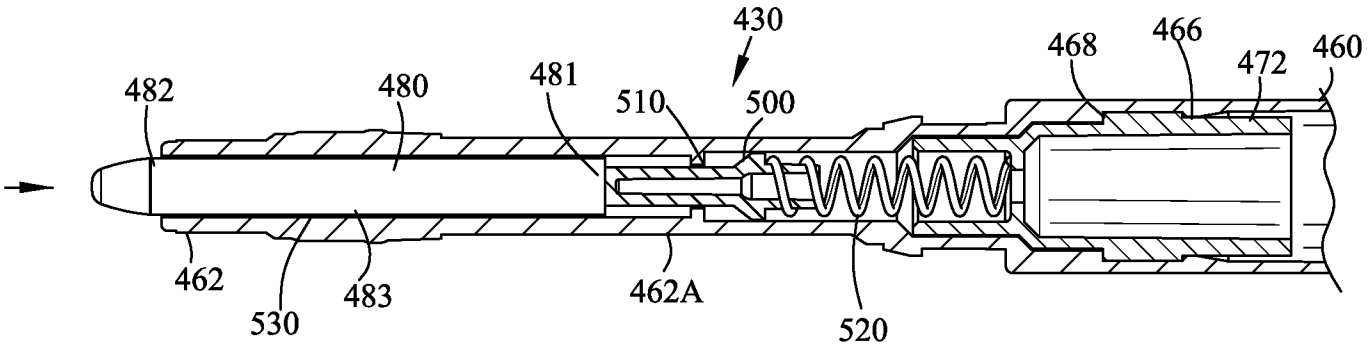
FIG. 27 is a view similar to FIG. 26 illustrating the dispensing valve in an open position.

As best shown in FIGS. 26 and 27, an internal annular projection 466 extends from an inner surface of the sidewall 463. A shoulder 468 is formed in the inner surface 464 of the intermediate portion 463A. The first end portion 461A of the inner body 460 is adapted to slidably receive a liquid applicator 480. The second end portion 462A of the inner body 460 is adapted to store the applicator liquid 6 in a supply reservoir 470. The intermediate portion 463A of the inner body 460 is adapted to receive the dispensing valve 430. An interlock 472 secures the liquid applicator 480 and the dispensing valve 430 within the inner body 460.

As best shown in FIG. 21, the applicator 480 extends between a proximal end 481 and a distal end 482. The applicator 480 is a generally cylindrically shaped member defining a cylindrical diameter 483 between the proximal end 481 and the distal end 482. The applicator 480 may formed from a highly compacted fibrous material such as polyester or other similar material having analogous properties sufficient to hold the original shape when moistened with the applicator liquid 6 but adequate to pass the applicator liquid 6 from the proximal end 481 to the distal end 482 of the applicator 480 by capillary action. In the alternative, the applicator 480 may be a non-porous material with grooves extending longitudinally along an outer surface of the applicator 480.

FIGS. 26-27 illustrate the dispensing valve 430 including a valve element 500, a valve seal 510, a spring 520. The interlock 472 engages the internal annular projection 466 and the shoulder 468 for affixing the valve body 490 to the inner body 460. The proximal end 481 of the applicator 480 is in direct engagement with the valve element 500.

FIG. 26 illustrates the dispensing valve 530 biased into a closed position by the dispensing spring 520. When the dispensing valve 530 in the closed condition, the valve element 500 is biased by the dispensing spring 520 into engagement with the valve seal 510. The engagement of the valve seal 510 prevents the passage of the applicator liquid 6 from the supply reservoir 470 to the applicator 480.

FIG. 27 illustrates the dispensing valve 430 in an open position upon depression of the applicator 480. A depression of the applicator 480 against a surface will compress the dispensing spring 520 and move the valve element 500 from the valve seal 510 for enabling the passage of the applicator liquid 6 from the supply reservoir 470 to the applicator 480.

The applicator liquid 6 moves from the proximal end 481 to the distal end 482 of the applicator 480 by capillary action. The applicator liquid 6 at the applicator 480 may be transferred to a surface by marking, dabbing or a brushing action.

The present disclosure includes that contained in the appended claims as well as the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A retractable liquid dispenser device, comprising
an outer body having an internal channel communicating between a first and a second open end;
a liquid dispenser comprising an inner body extending between a first and a second end;
said liquid dispenser having a supply reservoir and a discharge reservoir with a dispensing valve disposed therebetween;
a retractable actuator located at said first end of said inner body;
a liquid applicator having a proximal end and a distal end slidably disposed within said liquid dispenser at said second end of said inner body;
said proximal end of said liquid applicator engaging said dispensing valve;
said distal end of said liquid applicator extending from said liquid dispenser;
a retractable mechanism slidably supporting said liquid dispenser within said outer body;
a retractable valve located in proximity to said second end of said outer body;
a first depression of said retractable actuator opening said retractable valve and moving said liquid dispenser into an extended position for enabling a depression of said distal end of said liquid applicator to open said dispensing valve to permit liquid to flow from the supply reservoir into said dispensing reservoir to dispense the applicator liquid from said distal end of the liquid applicator; and
a second depression of said retractable actuator moving said liquid dispenser into a retracted position and closing the retractable valve to enclose said distal end of the liquid applicator within said outer body.

2. A retractable liquid dispenser device as set forth in claim 1, including a dispensing valve spring for biasing said dispensing valve into a closed position; and
a retractable spring for biasing said liquid dispenser into a retracted position.

3. A retractable liquid dispenser device as set forth in claim 1, wherein said retractable actuator is located in proximity to said first end of said outer body.

4. A retractable liquid dispenser device as set forth in claim 1, wherein said retractable valve is located in proximity to said second end of said outer body.

5. A retractable liquid dispenser device as set forth in claim 1, wherein said retractable valve cooperates with said retractable actuator through said liquid dispenser.

6. A retractable liquid dispenser device, comprising:
an outer body having an internal channel communicating between a first end and a second;
a liquid dispenser comprising an inner body extending between a first and a second end including:
a supply reservoir and a discharge reservoir;
a dispensing valve interposed between said supply reservoir and said discharge reservoir;
a liquid applicator located at said second end of said inner body;
said liquid applicator having a proximal end and a distal end slidably disposed within said liquid dispenser;
said proximal end of said liquid applicator engaging said dispensing valve;
said distal end of said liquid applicator extending from said liquid dispenser;
a retractable mechanism including
a mounting for slidably supporting said liquid dispenser within said outer body;
a retractable actuator engaging with said first end of said inner body for moving said liquid dispenser between a retracted position whereat said liquid dispenser is disposed within said outer body and an extended position whereat said distal end of said liquid applicator extends from said second end of said outer body;
a retractable valve located in proximity to said second end of said outer body cooperating with said retractable actuator;
a first depression of said retractable actuator opening said retractable valve and moving said liquid dispenser into said extended position for enabling a depression of said distal end of said liquid applicator to open said dispensing valve to permit liquid to flow from said supply reservoir into said dispensing reservoir to dispense the applicator liquid from said distal end of said liquid applicator; and
a second depression of said retractable actuator moving said liquid dispenser into said retracted position and closing said retractable valve to enclose said distal end of said liquid applicator within said outer body.

7. A retractable liquid dispenser device as set forth in claim 6 including a dispensing valve spring for biasing said dispensing valve into a closed position.

8. A retractable liquid dispenser device as set forth in claim 6, wherein said retractable mechanism includes a retractable spring for biasing said liquid dispenser into a retracted position.

9. A retractable liquid dispenser device as set forth in claim 6, wherein said retractable actuator is located in proximity to said first end of said outer body.

10. A retractable liquid dispenser device as set forth in claim 6, wherein said retractable valve encloses said distal end of said liquid applicator within said outer body for inhibiting evaporation of the applicator liquid from said distal end of said liquid applicator.

11. A retractable liquid dispenser device, comprising:
an outer body having an internal channel communicating between a first and a second open end;
a liquid dispenser comprising an inner body extending between a first and a second end and including
a supply reservoir and a discharge reservoir;
a dispensing valve interposed between said supply reservoir and said discharge reservoir;
a dispensing valve spring for biasing said dispensing valve into a closed position;
a liquid applicator having a proximal end and a distal end slidably disposed within said liquid dispenser;
said proximal end of said liquid applicator engaging said dispensing valve;
said distal end of said liquid applicator extending from said liquid dispenser;

a retractable mechanism including a mounting for slidably supporting said liquid dispenser within said outer body;

a retractable actuator secured to said first end of said inner body and located in proximity to said first open end of said outer body for moving said liquid dispenser between a retracted position whereat said liquid dispenser is disposed within said outer body and an extended position whereat said distal end of said liquid applicator extends from said second open end of said outer body;

a retractable spring for biasing said liquid dispenser into a retracted position;

a retractable valve located inside of said outer body in proximity to said open second of said outer body cooperating with said retractable actuator through said liquid dispenser;

a first depression of said retractable actuator opening said retractable valve and moving said liquid dispenser into said extended position for enabling a depression of said distal end of said liquid applicator to open said dispensing valve to permit liquid to flow from said supply reservoir into said dispensing reservoir to dispense the applicator liquid from said distal end of said liquid applicator; and a second depression of said retractable actuator moving said liquid dispenser into said retracted position and closing said retractable valve to enclose said distal end of said liquid applicator within said outer body for inhibiting evaporation of the applicator liquid from said distal end of said liquid applicator.

12. A retractable liquid dispenser device as set forth in claim 11, including a dispensing valve sub-assembly comprising said dispensing valve and said dispensing valve spring and said discharge reservoir and said liquid applicator; and an interlock for securing said dispensing valve sub-assembly within said inner body for defining said supply reservoir between said dispensing valve sub-assembly and said second end of said inner body.

* * * * *